US009085906B2

(12) United States Patent
Ward

(10) Patent No.: US 9,085,906 B2
(45) Date of Patent: Jul. 21, 2015

(54) SHEETROCK CORNER

(71) Applicant: Richard Ward, Eagle, ID (US)

(72) Inventor: Richard Ward, Eagle, ID (US)

( * ) Notice: Subject to any disclaimer, the term of this patent is extended or adjusted under 35 U.S.C. 154(b) by 0 days.

(21) Appl. No.: 14/075,924

(22) Filed: Nov. 8, 2013

(65) Prior Publication Data

US 2014/0123581 A1 May 8, 2014

Related U.S. Application Data

(60) Provisional application No. 61/723,904, filed on Nov. 8, 2012.

(51) Int. Cl.

| | |
|---|---|
| ***E04F 13/04*** | (2006.01) |
| ***E04F 19/02*** | (2006.01) |
| ***E04F 13/06*** | (2006.01) |
| *E04B 2/72* | (2006.01) |

(52) U.S. Cl.

CPC ..... *E04F 13/06* (2013.01); *E04F 13/042* (2013.01); *E04F 13/068* (2013.01); *E04F 19/022* (2013.01); *E04B 2002/725* (2013.01); *E04F 2013/063* (2013.01)

(58) Field of Classification Search

CPC ... E04F 13/042; E04F 13/06; E04F 2013/063; E04F 19/022

USPC ..... 52/254, 255, 256, 272, 287.1, 716.1, 52/717.01, 717.04

See application file for complete search history.

(56) References Cited

U.S. PATENT DOCUMENTS

| | | | | | |
|---|---|---|---|---|---|
| 2,234,701 | A * | 3/1941 | Lyman | 52/417 |
| 2,458,925 | A * | 1/1949 | Barger | 52/272 |
| 2,593,859 | A * | 4/1952 | Dunlap | 52/276 |
| 3,090,087 | A * | 5/1963 | Miller | 52/287.1 |
| 3,109,207 | A * | 11/1963 | Cooper | 52/255 |
| 5,131,198 | A * | 7/1992 | Ritchie et al. | 52/287.1 |
| 5,613,335 | A * | 3/1997 | Rennich et al. | 52/255 |
| 5,836,122 | A * | 11/1998 | Rennich et al. | 52/254 |
| 6,073,406 | A * | 6/2000 | Kearney | 52/287.1 |
| 6,131,348 | A * | 10/2000 | Dunham | 52/287.1 |
| 6,148,573 | A | 11/2000 | Smythe, Jr. | |
| 6,539,680 | B2 * | 4/2003 | Kunz et al. | 52/256 |
| 7,013,610 | B2 | 3/2006 | Kunz | |
| 7,214,434 | B2 * | 5/2007 | Dalgleish et al. | 428/537.5 |
| 7,673,428 | B1 | 3/2010 | Smythe, Jr. | |
| 2002/0073638 | A1 | 6/2002 | Kunz et al. | |
| 2003/0033770 | A1 * | 2/2003 | Harel | 52/287.1 |
| 2006/0070324 | A1 * | 4/2006 | Daly, IV | 52/287.1 |
| 2006/0070331 | A1 | 4/2006 | Yakobics | |
| 2006/0101746 | A1 | 5/2006 | Smythe, Jr. | |
| 2006/0236626 | A1 | 10/2006 | Smythe, Jr. | |
| 2006/0283115 | A1 * | 12/2006 | Robertson | 52/364 |
| 2013/0186024 | A1 * | 7/2013 | Rosentiel et al. | 52/255 |
| 2014/0096464 | A1 * | 4/2014 | Rosenthal et al. | 52/287.1 |
| 2014/0123581 | A1 * | 5/2014 | Ward | 52/287.1 |
| 2014/0260019 | A1 * | 9/2014 | Conboy | 52/255 |

* cited by examiner

*Primary Examiner* — Ryan Kwiecinski

(74) *Attorney, Agent, or Firm* — Scott D. Swanson; Shaver & Swanson, LLP

(57) ABSTRACT

What is disclosed is a sheetrock corner bead that features an elongated core and paper flange extension for the elongated core. The flanges provide a layered tapered appearance that allow for less mud to be used and fewer mud applications required for installing the corner. The sheetrock corner bead provides for an improved method of installation that generally requires less mud and less time spent in installation.

19 Claims, 19 Drawing Sheets

SHEETROCK CORNER

PRIORITY/CROSS-REFERENCE TO RELATED APPLICATIONS

This application claims the benefit of U.S. Provisional Application No. 61/723,904 filed Nov. 8, 2012, the disclosure of which is incorporated by reference.

BACKGROUND

Customarily when finishing drywall construction workers use various types of corner beads to finish the corners around doors, windows, and the edges of walls. These walls are typically framed in either 2"×6" or 2"×4" framings with half inch or ⅝" drywall. Generally the drywall corner bead comprises a paper combined with metal corner, known as tape on corner bead and the metal and paper has a centerline with two metal flanges. Drywall corner bead can also be a metal corner that is fastened to the wall and mudded over. These flanges are fairly short and have an extended paper flange for attaching to a wall typically via joint compound (also known as mud). In this situation, typically the corner bead contains a recessed portion created along the two opposing flanges of the metal nose or point and a paper layer over the metal portion to allow for adhering to sheet rock. The recessed portion is prominent in the corner when the paper exterior sheet is present on the metal section, as is the case when the corner is applied in sheetrock finishing. This recessed portion allows for a worker to fill the recessed portion with mud, which is commonly known to those having experience in sheetrock/drywall application.

Customarily in dry wall applications, mud is applied with a trowel, a knife, or with the worker's hands or tools with similar function. The worker uses similar tools to smooth the mud and/or to remove excess mud. When the worker applies the corners disclosed in the previous art, the worker has to 1) apply mud to sheet rock surface with knife or with mud hopper, 2) press the corner firmly in place, 3) wipe paper edges of the corner bead to remove excess mud, 4) roll the corner into place with corner bead roller then remove excess mud, 5) allow mud layer to dry, 6) sand dried layer and apply an additional layer of mud and allow to dry, 7) sand dried layer and apply additional layer of mud and allow to dry. The worker must return sand and apply mud to areas needed per required finish. This mudding and sanding must be done before the worker can prime the wall for painting or texturing in order to generate a smooth corner. What is needed is a simple to apply corner that a worker does not have to repeatedly apply mud to, thus saving the worker time and material.

In tape on corner bead applications mud is applied to the sheetrock by hand using a drywall knife, trowel or mud application too. Mud can also be applied directly to corner bead by use of a sluice box or hopper to apply mud to the corner. The corner bead flanges are then affixed by using a corner bead roller, with excess mud being removed by hand using a drywall knife, making the edges of the corner bead smooth and attached.

SUMMARY OF THE DISCLOSURE

A disclosed embodiment has an elongated core having an outer surface and an inner surface. The elongated core has two flanges extending outward from the center of the elongated core. The flanges have a recessed portion beginning at a point outward from the center of the elongated core. This outward section of the flange has a paper section which abuts the end of the flange. On top of this core layer is an outer layer or exterior paper section that is attached to the inner of the core and to the paper section that is attached beginning at the recessed portion of the elongated core and extends outward to the end of the section abutting the elongated core. There is also an interior section that is on the inside of the corner. This section is configured for attachment to sheetrock. The outer section is such that it can be made out of fire resistant or mold resistant paper. The outer section is designed to be finished using a texture or can just be painted. The overall appearance of the corner provides a staggered tapered appearance such that the outer layer is wider than the interior layer. This allows for the sheetrock mud to placed along the tapered portion such that the a worker does not have to apply multiple sequential layers of mud followed by sanding between each application of mud. Once the corner is applied to the sheetrock wall, the mud on the edges of the corner can be sanded and the entire corner can be textured along with the sheetrock wall and subsequently painted.

In a preferred embodiment, the elongated core is a galvanized metal elongated core. It is in a preferred embodiment that this elongated core be 0.015 inches thick. In a preferred embodiment the overall flange length of the entire corner is between 1½ inches and 5¼ inches. This will allow for a variety of corners. In the event that the flange is too long for the worker, the worker can use a knife, such as a utility knife to cut the flange down to the correct size. Two opposing flanges can be of various sizes depending on the corner type that the corner is going to be installed on. The staggered tapered appearance of the corner allows for mud to be placed toward the edge of the corner and less mud to be used as the paper corners are tapered.

It is thought that the tapering of the papered corner will allow for a layer of mud to be placed on the corner, the corner to be smoothed down, excess mud removed, the corner sanded, if necessary, without additional applications of mud. This will provide for faster application of the corner because a worker, in the traditional methodology in which the recessed portion of the flange is not filled by paper, but instead is filled by mud that is sequentially layered and sanded several times in order to provide the overall finished appearance in which the corner tapers into the sheetrock.

BRIEF DESCRIPTION OF THE DRAWINGS

FIG. 10PP is an isometric detail view of the finished and filled FIG. 10P.

FIG. 19PP is an isometric detail view of the finished and filled FIG. 19P.

DESCRIPTION OF THE PREFERRED EMBODIMENTS

Figure 1:
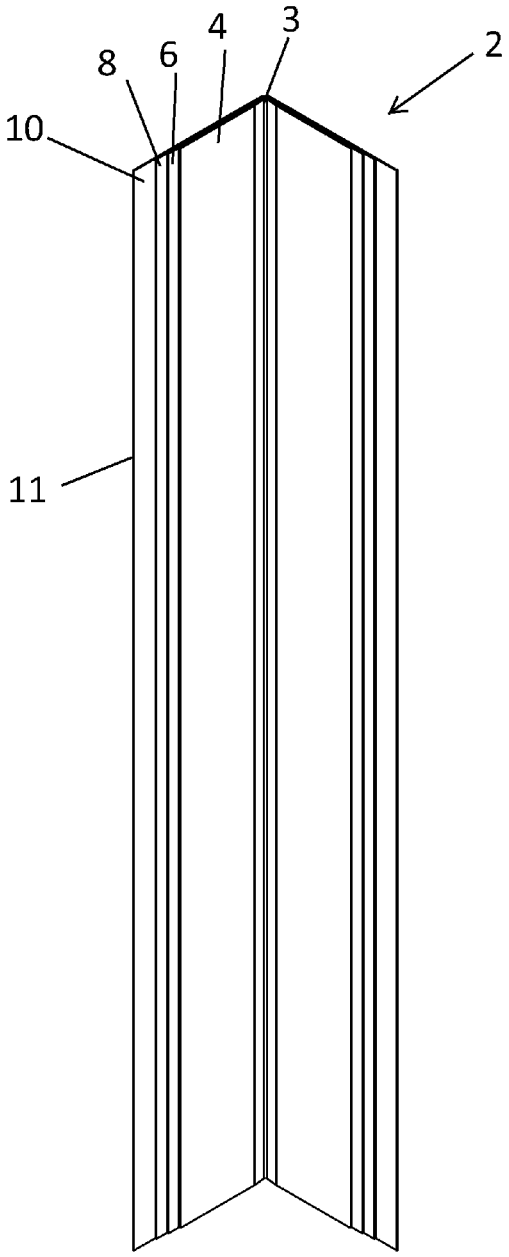
FIG. 1 is an isometric view of the new corner bead.

FIG. 1 illustrates an isometric view of the new corner bead. The new corner bead is constructed such that minimal mud is needed to finish the corner bead. The newly disclosed corner bead 2 of the application features a metal or plastic support corner 3 that is attached to layers (or sections) of paper, such that the paper forms a gradual tapering from the thicker center part of the corner 3 down to the edge of the corner bead 11. This allows for the gradual tapering of the corner bead and allows for the mud just to be applied in fewer applications, such that multiple layers and drying time for the mud and subsequent multiple sandings are not needed. This is done by providing the corner 3, which in a preferred embodiment which is approximately 0.015 inches thick (in other wording, approximately ⅛" thick). This corner, in a preferred embodiment is thirty gage galvanized metal, can also be made using plastic or a combination of metal and plastic. The preferred width of each of the flanges of the metal is approximately ⅜ inch with paper extending the width up to 5¼ inches. It is thought that this is the preferred width that can be used, although smaller or wider could be potentially used.

The internal layers of paper 4,6,8 are preferably made from a 9 pt suture stock (5111-120). This paper is made by Monadnock in a preferred embodiment, although any paper will work consistent with the spirit of the current invention. The outer paper layer 10 is preferably made from drywall trim paper (1720-097) also constructed by Monadnock which can be treated with a mold or fire resistance paper.

Figure 1P:
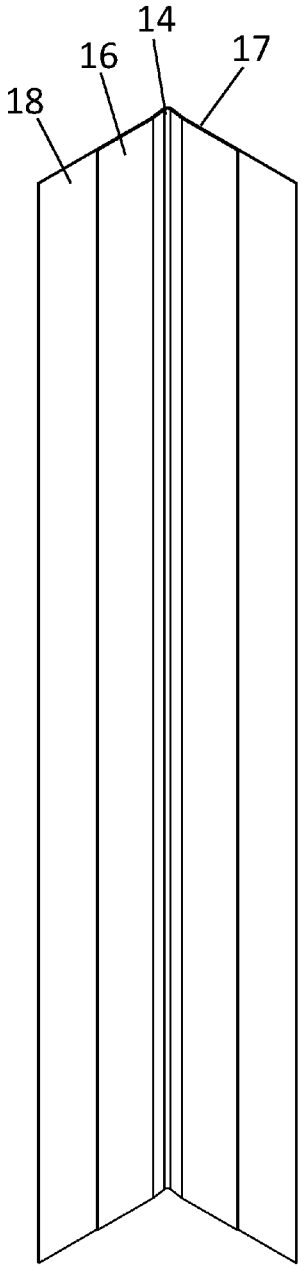
FIG.1P PRIOR ART
FIG. 1P is an isometric view of the prior art corner bead.

FIG. 1P illustrates what is thought to be the current prior art in a generalized drawing. Illustrated in FIG. 1P, the prior art features a central metal or plastic corner 14, as well as an extended paper 18. These paper flanges are not tapered from a uniform flat exterior to the end and instead flange provides an indented section such that corner 14 provides recess 17, that is filled with mud in sequential applications. This gap is filled with mud adhesive typically at least three times, with each of the layers being allowed to dry and typically are sanded before another layer of mud is applied in sequence. This leads to substantial increase of time in preparing drywall corners. The layered paper corner bead of the current invention uses a minimal metal or plastic center, although other material consistent with the spirit of the invention may be used.

Mud or adhesive is applied to the outside paper near the edge such that the adhesive or mud is layered over the edge of the paper onto the sheetrock. This outer paper is to be pre-finished for text or paint such that is not required to mud or outer adhesive before applying any further paint or texture. It is thought that in an ideal situation in which the framing of the building has been relatively straight, minimal mud will be needed on the paper bead in order to generate a proper corner. However, in the event that the framing is crooked or off center, multiple layers of mud can be used in order to square the corner. The paper can also be made with nodules for using mud to apply the corner of the wall to enhance mud application. This generates increased mud adhering to the paper of the corner bead. Alternatively, the paper can be left smooth to adhere by using glue. The pre-finished outside paper can be primed or textured without having coating with anything. Again, any type of metal or plastic can be used to make the corner consistent with the spirit of the invention. Alternatively, the corner bead can be made in a variety of corners, including square kerf jambs, bullnosed, baby bull, L-metal, an open angle or one thirty five degrees corner. The paper flange (and overall width of the flange of the corner bead) is generally from 1¼ inches to 5¼ inches wide depending on the overall width of the corner to be finished. A worker can finish the edge using either his or her hand or with tools. The corner bead can also be taped on and finished over.

A typical building is framed using 2"×4" or 2"×6" framing with ½ inch or ⅝ inch drywall. Thus a 1¼ to 5¼ inch corner bead flange can be used, eliminating coating at all on window returns while adjusting for different window thickness, between ½ inch to 1¼ inch. The worker can trim paper edge with razor knife as needed to match the window width. Thus 5¼ inch corner bead width reaches the window. There is no need to coat the window return with mud. This is, for example, illustrated in FIG. 10.

Figure 2:
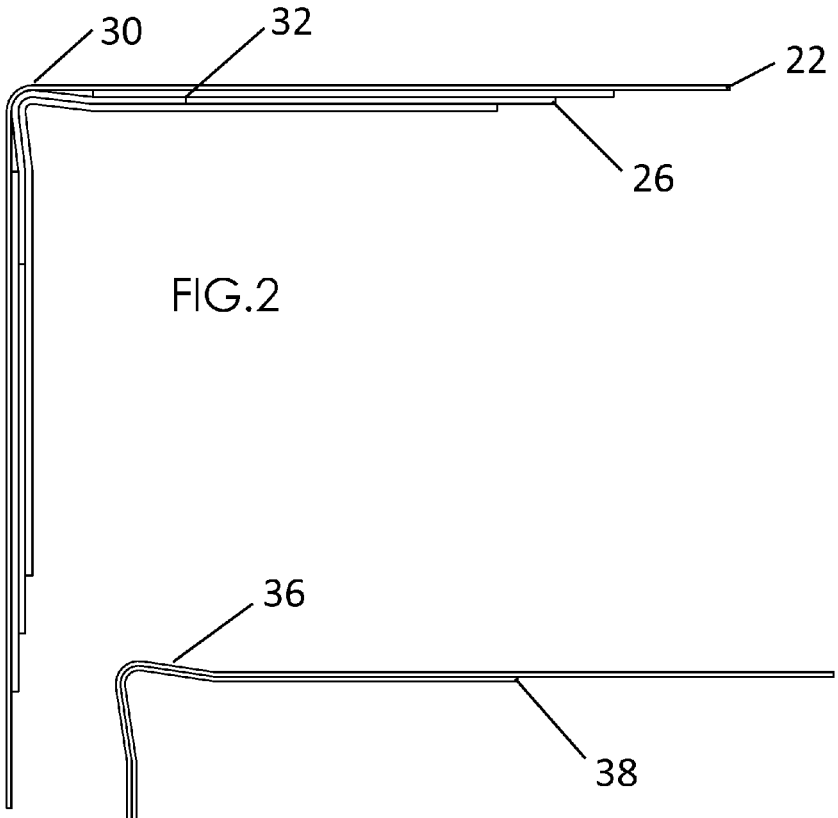
FIG. 2 is a top view of the new corner bead. It shows a small piece of angled metal and four layers of paper. The outside mud fill areas are eliminated.
Figure 2P:
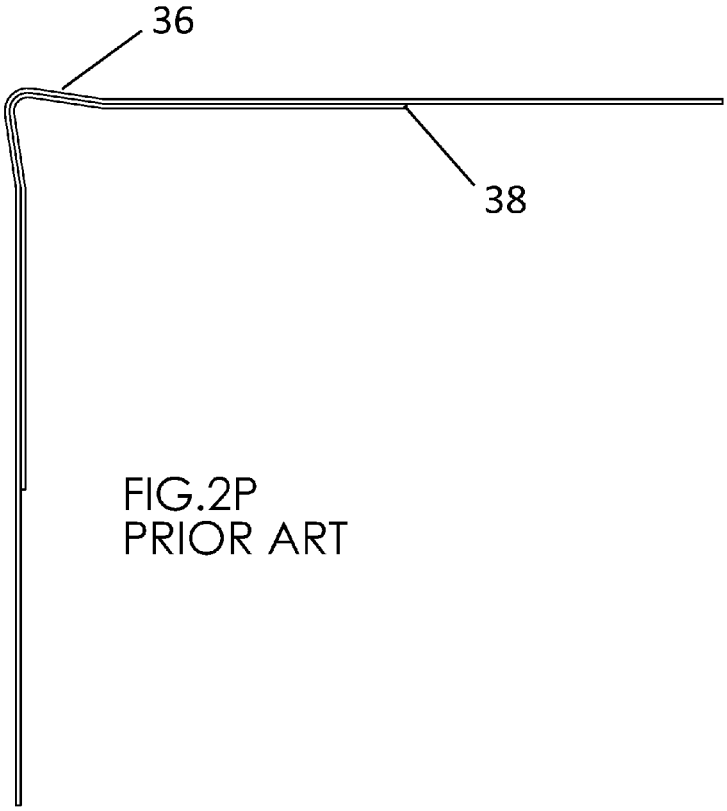
FIG.2P PRIOR ART
FIG. 2P is a top view of the prior art corner bead. It shows a large piece of angled metal and one layer of paper. Prior art corner bead has outside mud fill areas on the part.

FIG. 2 illustrates a top view of the new corner bead. As illustrated the length of elongate core 32 is slightly angled and is attached to four layers (also called sheets or sections) of paper to provide the new corner bead. In contrast FIG. 2P shows what is thought to be the prior art. Prior art features a wider metal core 38 and includes a single layer of paper 36. As illustrated in FIG. 2, the four layers of paper of the current invention creates a layered corner that provides for the general tapering of the corner from the point of the corner to the edge of paper 22. This alleviates the need to fill the recess that is created by the angle of the core 32. The small piece of metal 32 abuts with paper 26 such that the length of the piece of metal (or other core material) needed is reduced, thus likely decreasing cost of manufacturing the corner. The increased paper layers add longer rigidity to the corner without requiring a longer metal flange as shown in FIG. 2P, 38.

Figure 3:
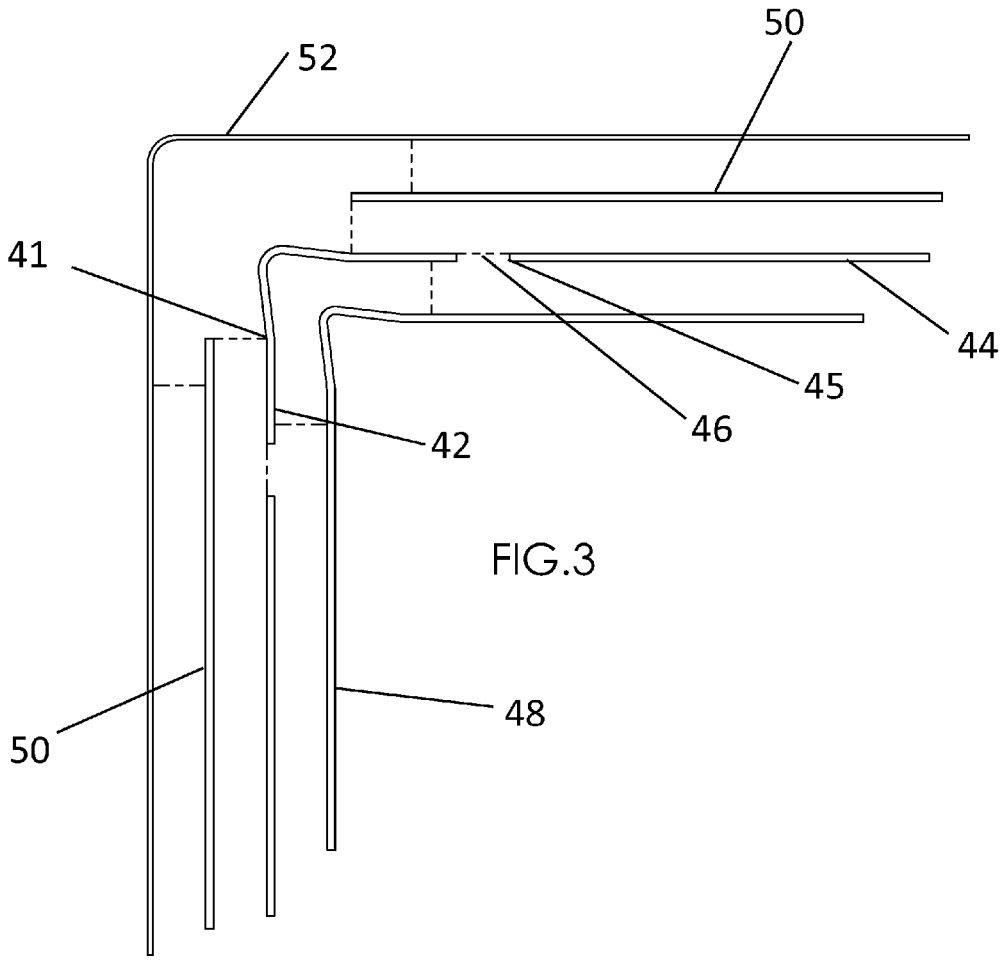
FIG. 3 is a top exploded view of the new corner bead.

FIG. 3 illustrates a top exploded view of the new corner bead. FIG. 3 illustrates the outer paper layer 52 that is attached to elongated metal core 42. The elongated metal core 42 is attached to a layer of paper 50 that fills recessed portion 41. Recessed portion 41 is approximately a ⅛ inch fill gap that is filled by paper 50. The thickness of the interior layer 48 being generally 0.015 inches, second layer 44 is generally 0.015 inches, the third layer is generally 0.01 inches and the outer layer is generally 0.09 inches. This is thought to be the preferred embodiment, is exemplary of the invention, and is not meant to be limiting to the paper width. The edges as depicted in FIG. 3 are generally tapered in a preferred embodiment in order to provide a layered structure. The distance between the tapered edges of the four layers of paper is thought in a preferred embodiment to be 1/4 to ¾ of an inch although it can be smaller or greater depending on a worker's need. In a preferred embodiment, 9/16" to ⅝" is the preferred distance between the edges of the paper. As illustrated elongate core 42 abuts with edge portion 45 at seam 46. This allows for the continued layering of the paper layers from the center metal portion.

Figure 4:
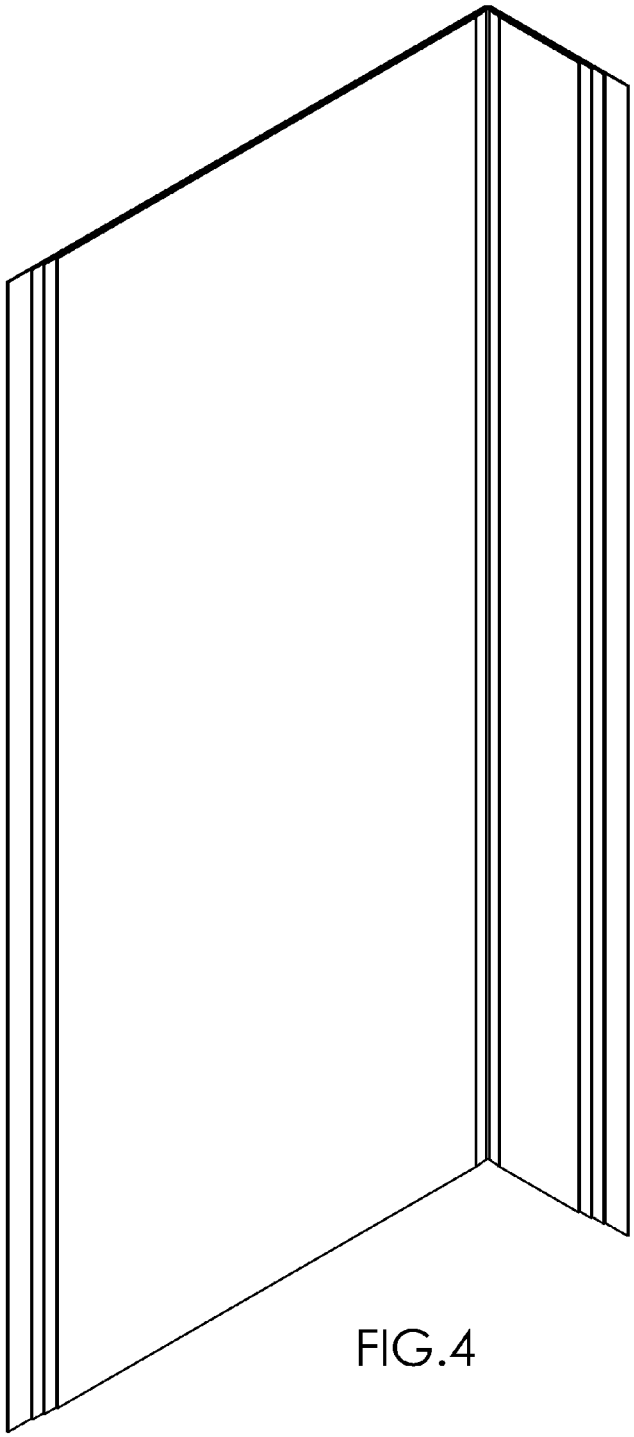
FIG. 4 is an isometric view of the new corner bead normally used in windows using 2"×6" window framing.

FIG. 4 illustrates an isometric view of the new corner bead designed for windows using 2"×6" window framing. The corner bead is generally in four layers or sections to create the staggered tapered appearance, although additional layers or sections could be added.

Figure 5:
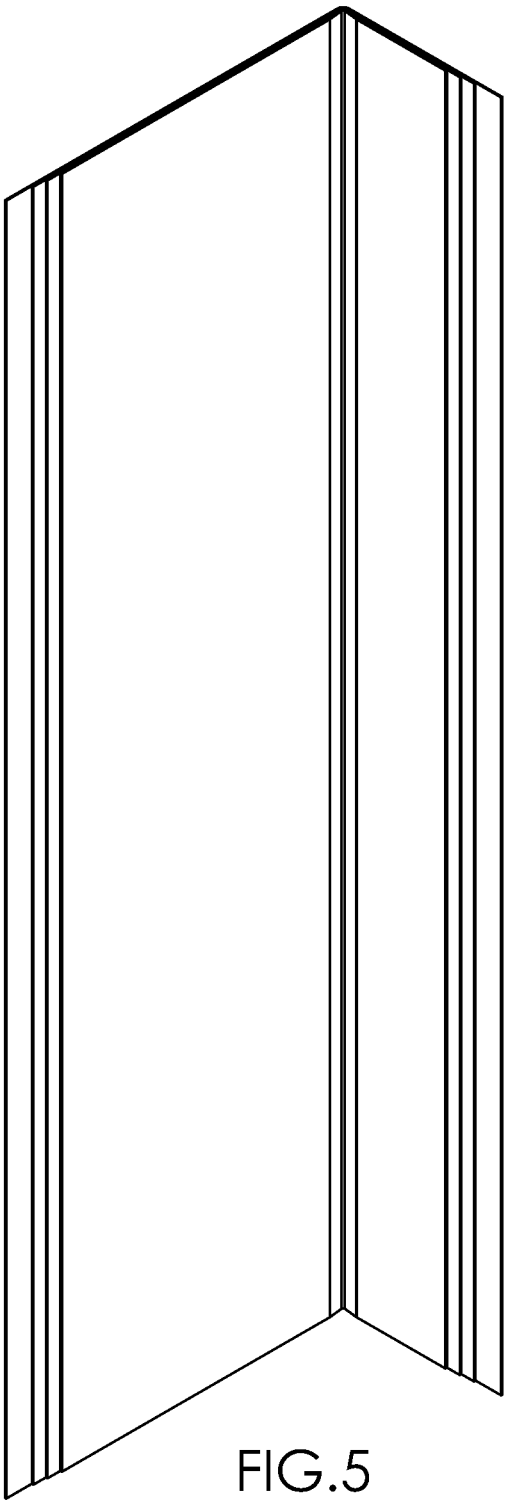
FIG. 5 is an isometric view of new corner bead normally used in windows using 2"×4" window framing.
Figure 6:
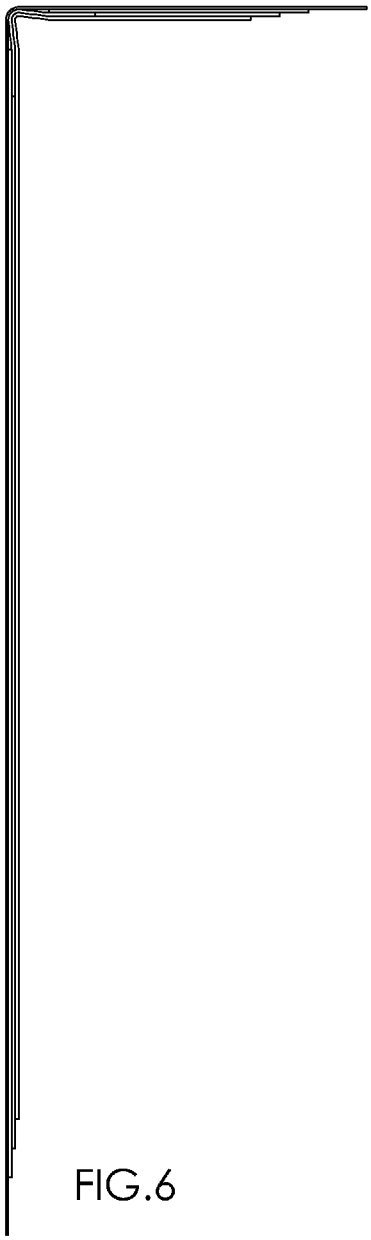
FIG. 6 is a top view of the new corner bead normally used in windows using 2"×6" window framing. The metal and paper layers are similar to FIG. 2.
Figure 7:
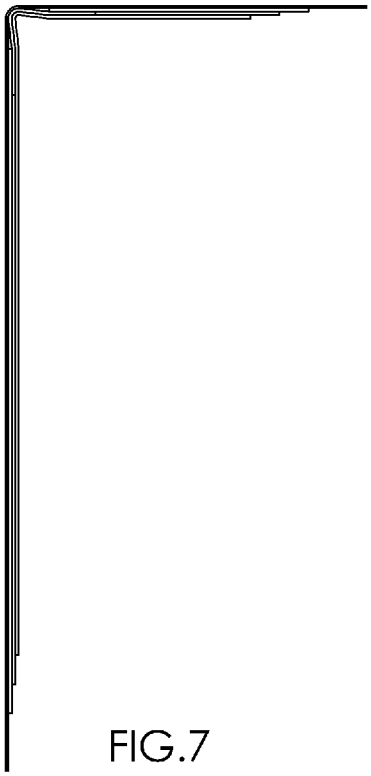
FIG. 7 is a top view of new corner bead normally used in windows using 2"×4" window framing. The metal and paper layers are similar to FIG. 2.

FIG. 5 illustrates an isometric view of a new corner bead used in windows that are framed using 2"×4" window framing. FIGS. 6 and 7 illustrate the top views of the new corner bead for 2"×6" window framing and 2"×4" window framing, respectively. As illustrated for the 2"×6" window corner 62 there is an elongated flange due to the wider stud of the window framing. In contrast, the 2"×4" window framing uses a smaller flange, as illustrated. The edge of the flange abuts with the window, allowing for the entire framing to be finished with minimal mud application and sanding.

Figure 8:
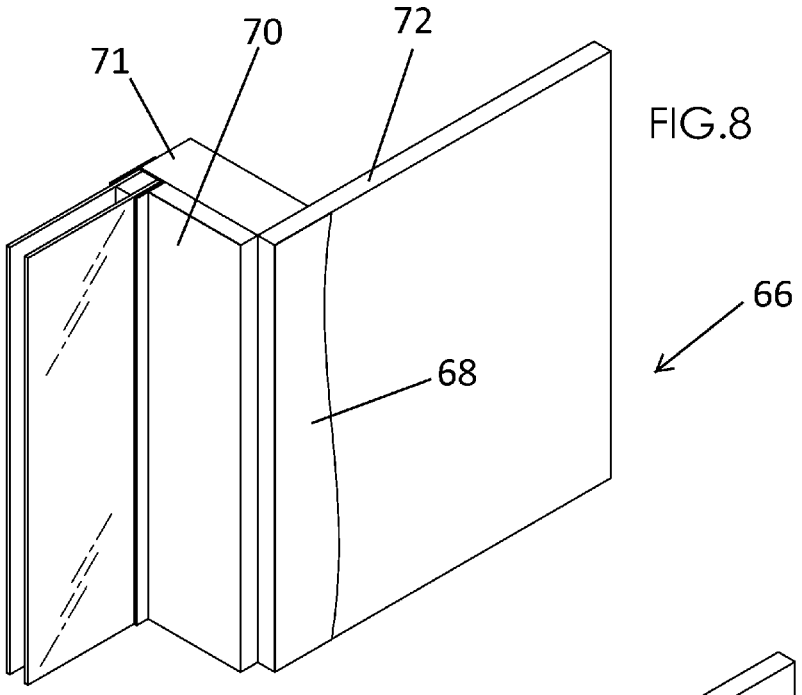
FIG. 8 is an isometric view showing the wall preparation for a window corner using 2"×4" walls. This wall preparation applies to the use of both (corner bead FIG. 7) and (bullnose FIG. 12).
Figure 8P:
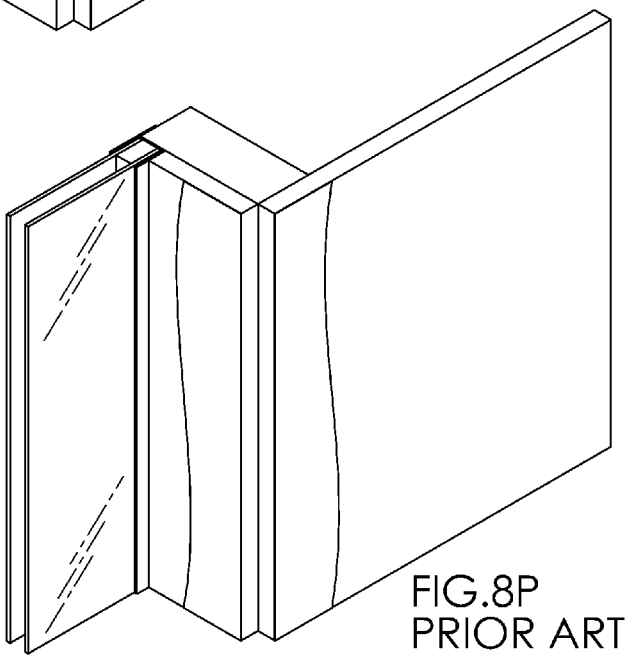
FIG.8P PRIOR ART
FIG. 8P is an isometric view showing the prior art wall preparation for a window corner using 2"×4" walls. This wall preparation applies to the use of both (corner bead FIG. 2P) and (bullnose FIG. 12P).
Figure 9:
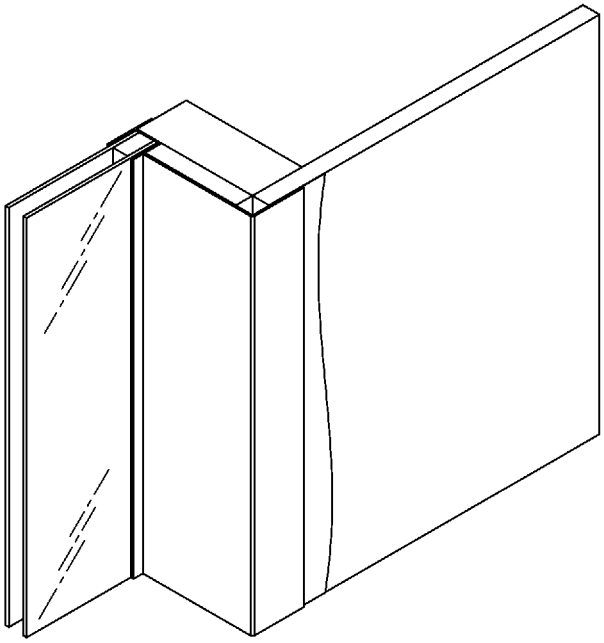
FIG. 9 is an isometric view showing next installation step after FIG. 8 for the new corner bead.
Figure 9P:
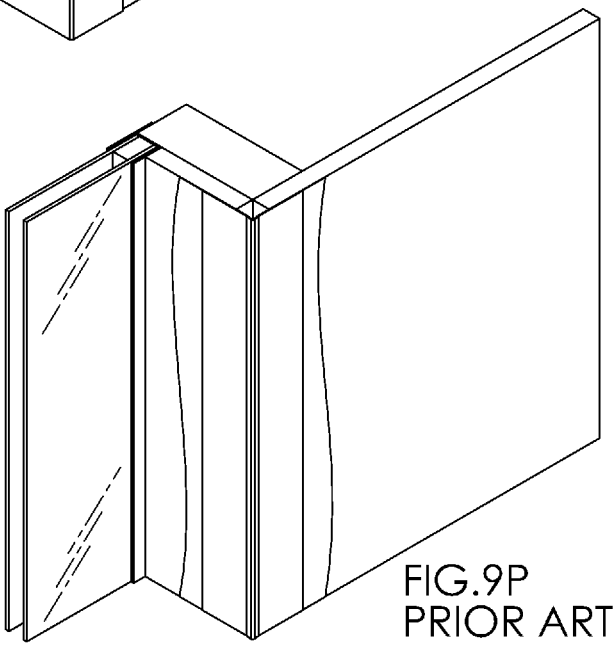
FIG.9P PRIOR ART
FIG. 9P is an isometric view showing next installation step after FIG. 8P for the prior art corner bead.

FIG. 8 illustrates an application of a corner to a windowed wall section. FIGS. 8 and 8P illustrate what must be done to prep the wall corner before both the current invention or the prior art can be applied as a corner. FIG. 8 illustrates the current invention, while FIG. 8P illustrates the standard prior art. FIG. 8 illustrates the sheetrock wall corner 66 having first sheetrock wall 70 and second sheetrock wall 72 against stud 71. Mud is placed on the whole sheetrock surface of sheetrock 70. The entire surface 70 of sheetrock wall 70 or alternately on the whole inside surface of the corner bead, or bullnose. Mud is also placed on the sheetrock wall from the closest edge of the sheetrock to the point 68 beyond where the corner bead or will cover. Subsequently, the comma as illustrated in FIGS. 9 and 9P, the corner bead is placed over the mud then pressed in place with a roller or taping knife. Excess mud is then wiped off.

Figure 10:
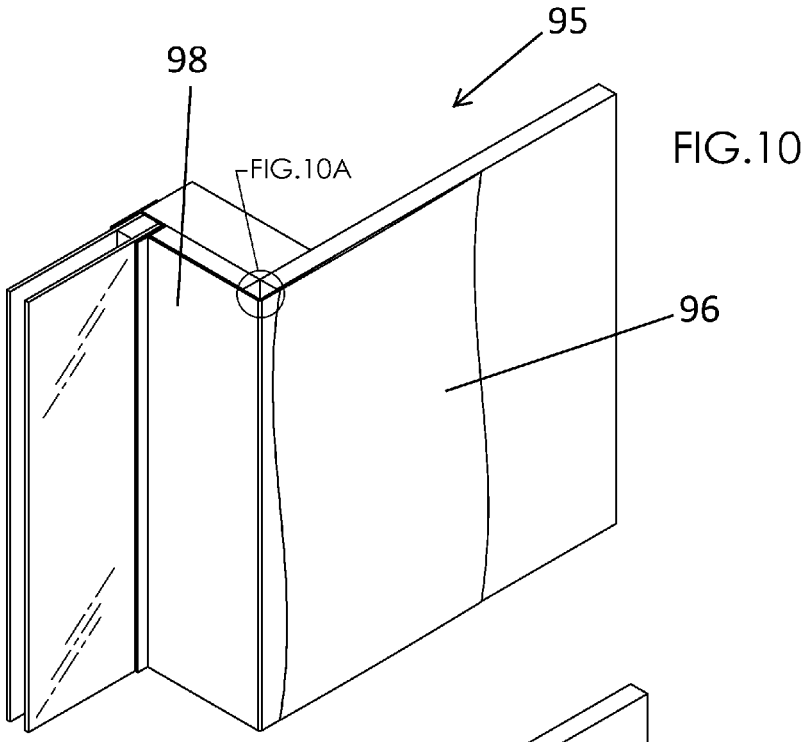
FIG. 10 is an isometric view showing next installations step after FIG. 9 for the new corner bead.
Figure 10P:
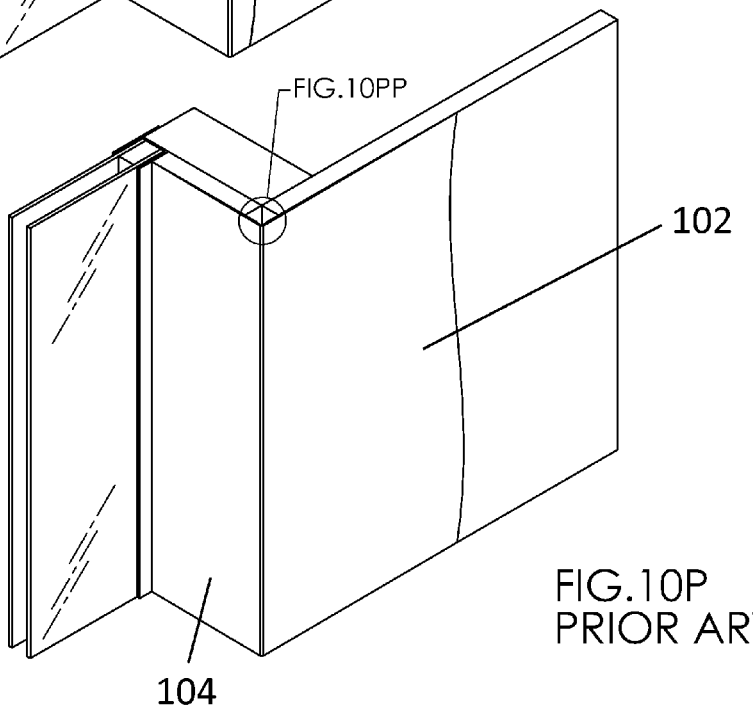
FIG.10P PRIOR ART
FIG. 10P is an isometric view showing the results for the next three installation steps after FIG. 9P for the prior art corner bead.
Figure 10A:
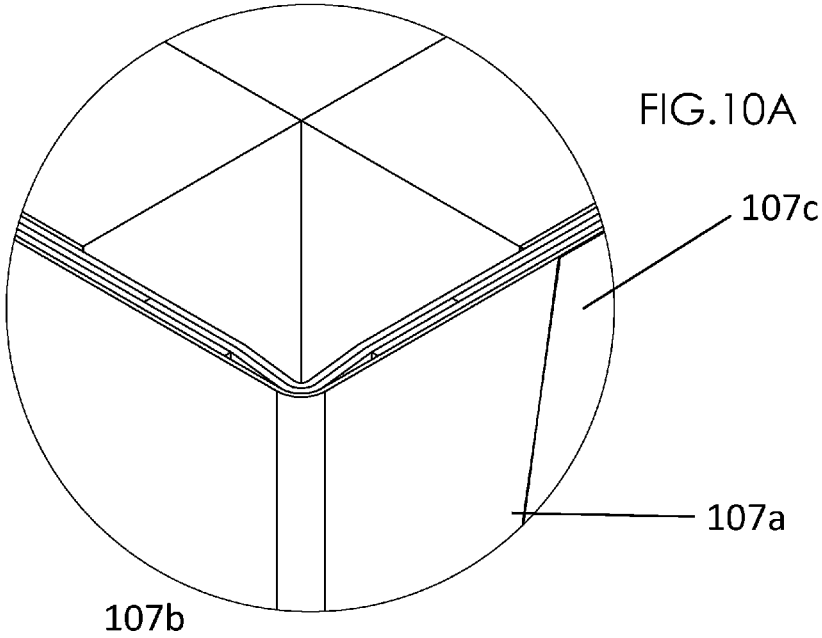
FIG. 10A is an isometric detail view of the finished corner for FIG. 10.
Figure 10P:
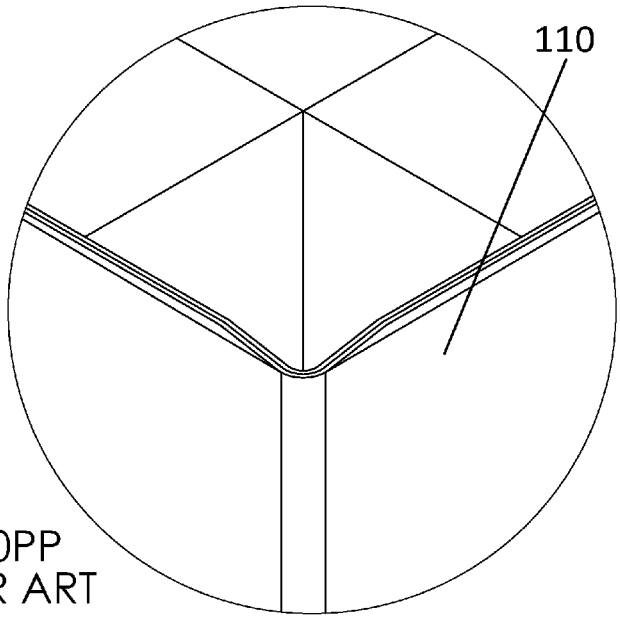
FIG.10PP PRIOR ART

FIGS. 10A and 10PP illustrate where mud is required on each of the perspective current invention and the prior art. In the current invention, minimal or no mud is required on the exterior of the corner 107*a*, 107*b*, but is required on the exterior of the corner at 107*c*. This is because mud is not required to fill in the gap provided as shown in the prior art. In the prior art, mud must be used to cover the entire sheetrock surface 110. Mud may need to be applied up to three times or even more depending on the shrinkage and drying of the mud on the sheetrock wall.

Figure 11:
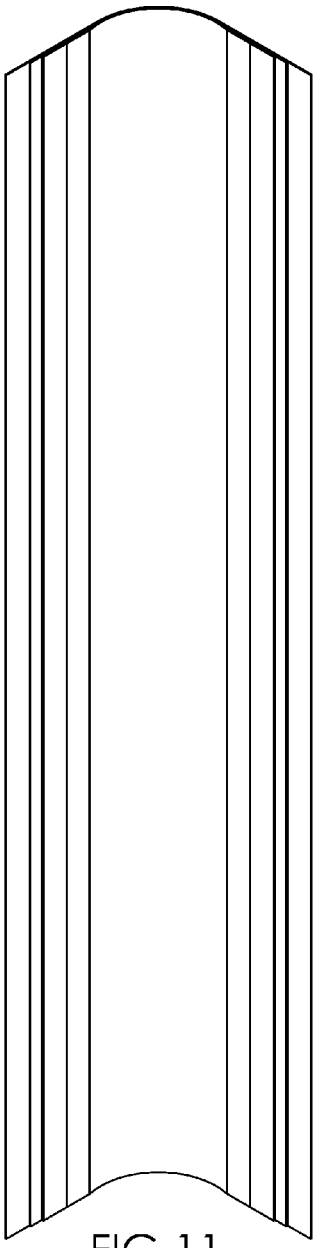
FIG. 11 is an isometric view of the new bullnose.
Figure 11P:
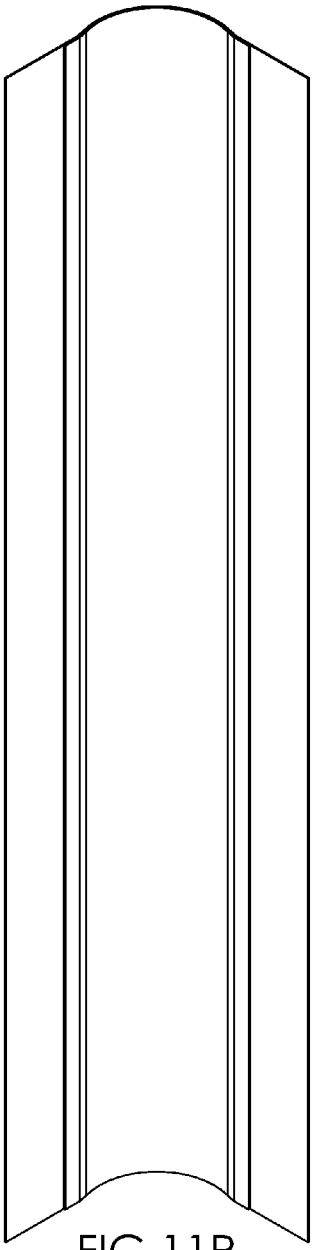
FIG.11P PRIOR ART
FIG. 11P is an isometric view of the prior art bullnose.
Figure 12:
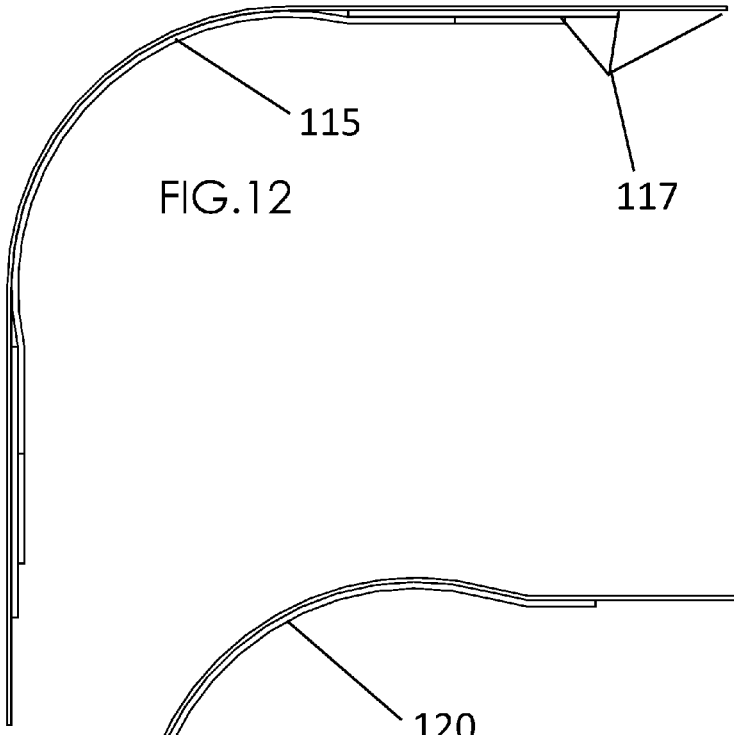
FIG. 12 is a top view of the new bullnose. It shows a reduced curved metal support and three layers of paper. The outside mud fill areas are eliminated.
Figure 12P:
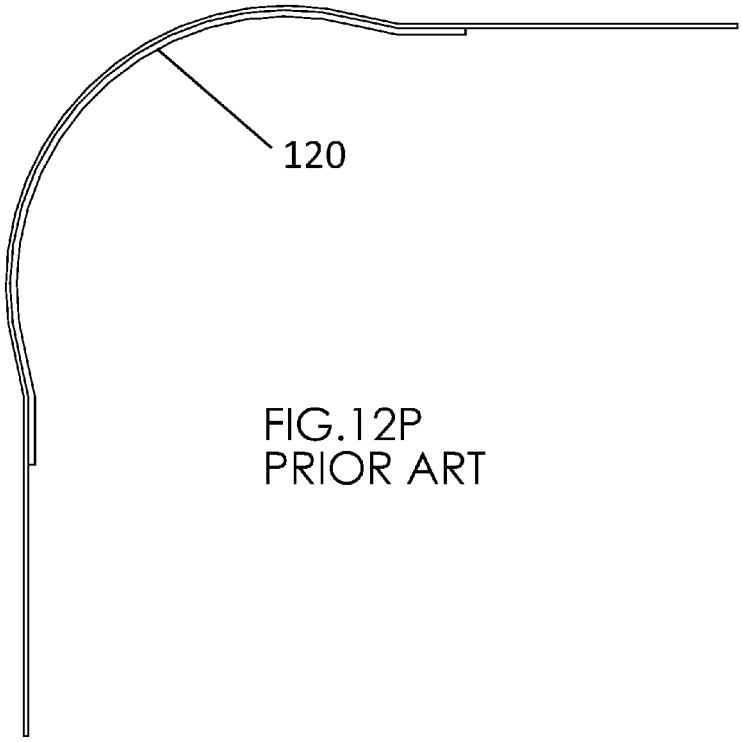
FIG.12P PRIOR ART
FIG. 12P is a top view of the prior art corner bead. It shows a large piece of angled metal and one layer of paper. It has outside mud fill areas on the part.
Figure 13:
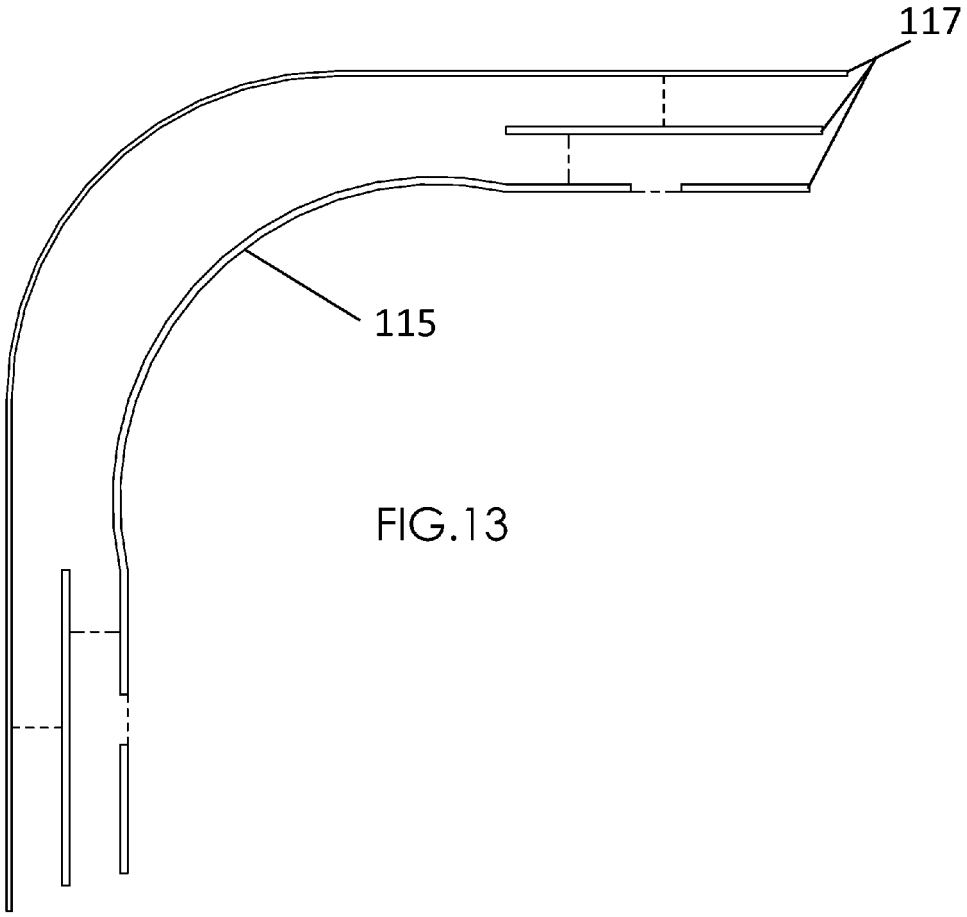
FIG. 13 is a top exploded view of new bullnose.

FIG. 10 illustrates a sheetrock window corner according to the present invention, while FIG. 10P illustrates a sheetrock corner according the prior art. As illustrated in FIG. 10, mud is spread over flange 96 of corner 95. Flange 98 does not require mud as it is adhered to the sheetrock behind it by the previously applied mud or adhesive. In FIG. 10P mud is required to be applied to both 102 and 104. Again this mud is required to be applied in sequential layers and subsequently sanded after each layer. This allows for filling the gap as illustrated in FIG. 10PP. FIGS. 11 through 13 represent the standard size of bullnose used for the invention. Bullnose, or round corner bead is used to create rounded corners. The corner and method can also be used on the interior of corner wall.

FIG. 13 illustrates an exploded view of the round bullnose corner, having paper sections 117 and metal section 115. The corner differs from the prior art as the prior art has a recessed section that is to be filled with mud and sanded to finish the corner.

Figure 14:
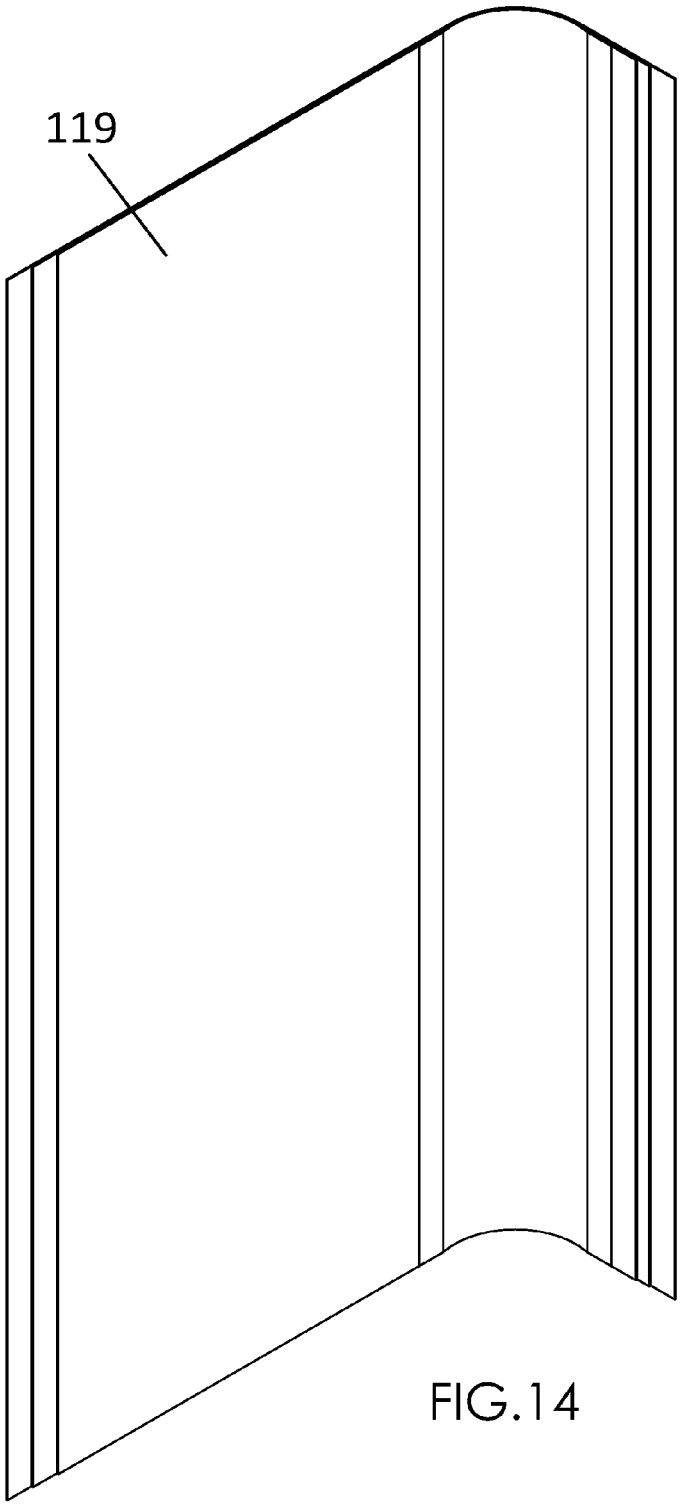
FIG. 14 is an isometric view of the new bullnose, used with 2"×6" window framing.

FIG. 14 illustrates a further view of the rounded end bullnose with an elongated flange 119.

Figure 15:
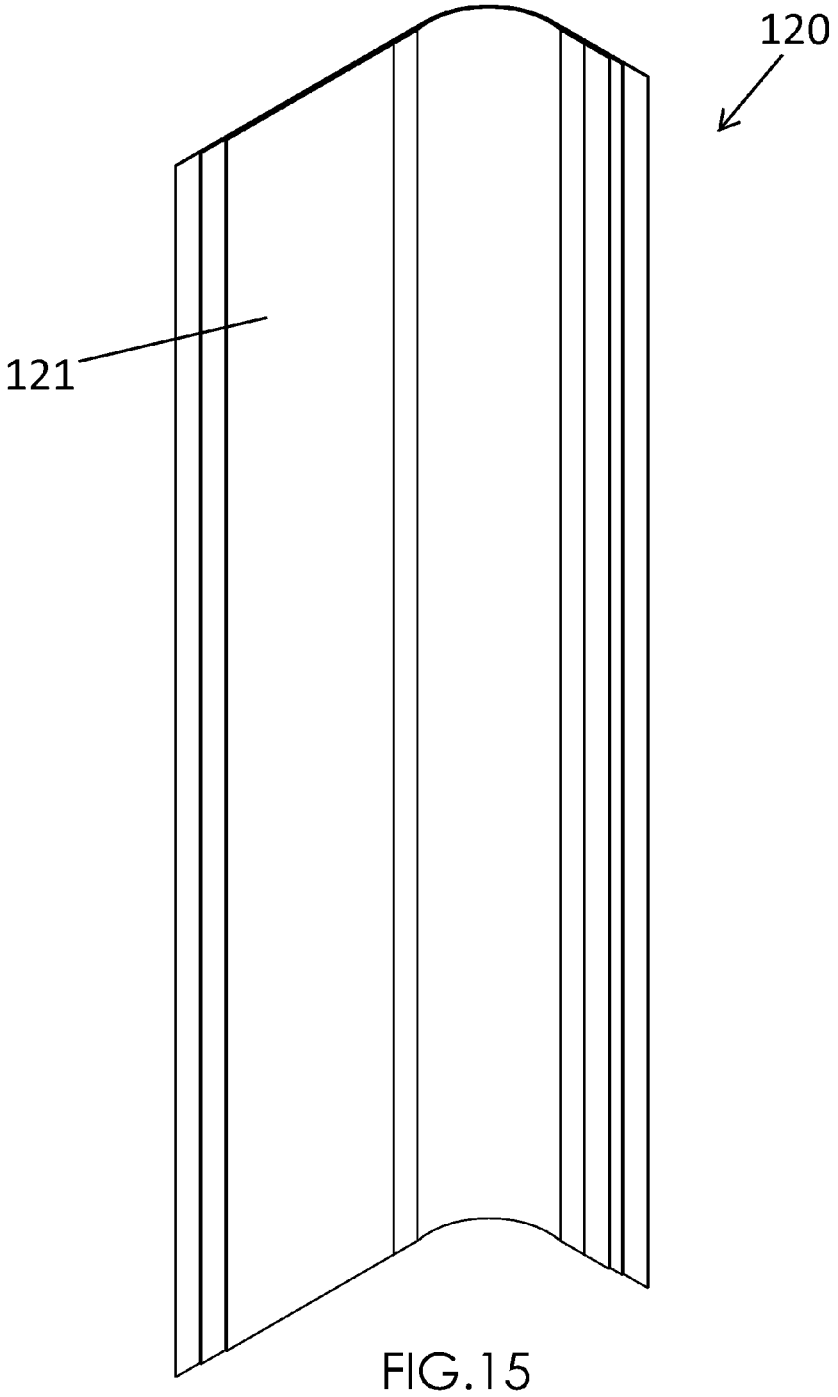
FIG. 15 is an isometric view of the new bullnose, for use with 2"×4" window framing.

FIG. 15 illustrates a rounded bullnose section 120 having an elongated flange 121.

Figure 16:
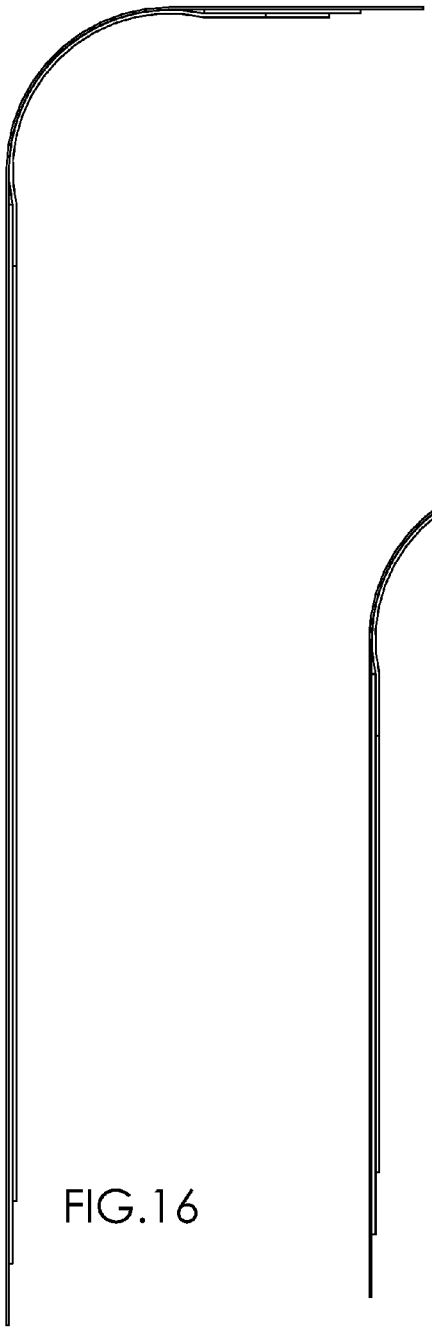
FIG. 16 is a top view of new bullnose, for use in windows using 2"×6" window framing.

FIG. 16 illustrates the top view of the bullnose corner of the current invention to be used in windows having 2"×6" framing.

Figure 17:
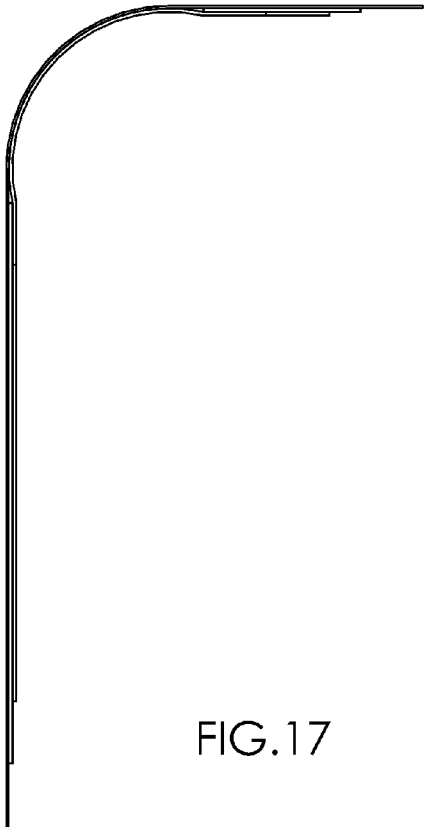
FIG. 17 is a top view of new bullnose, for use in windows using 2"×4" window framing.

FIG. 17 illustrates the top view of the new bullnose used in windows having 2"×4" framing.

Figure 18:
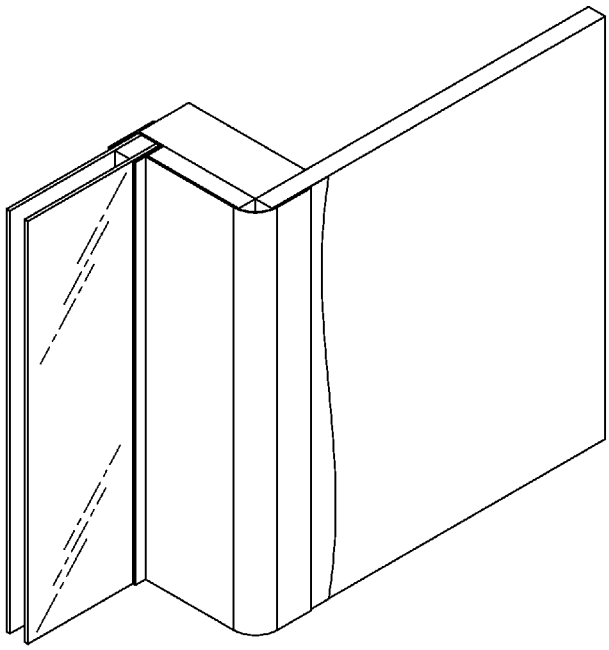
FIG. 18 is an isometric view showing the new bullnose installation for a window in a 2"×4" wall. This step follows the wall preparation shown in FIG. 8.

FIG. 18 illustrates an isometric view showing the new bullnose installed in 2"×4" window framing. This follows the same wall preparation steps shown in FIG. 8 and associated figures, illustrating steps for applying the corner.

Figure 18P:
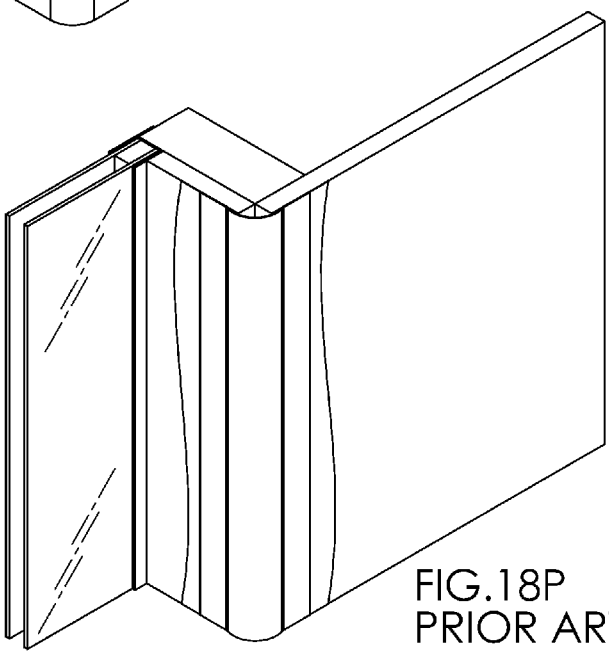
FIG.18P PRIOR ART
FIG. 18P is an isometric view showing prior art bullnose installation for a window in a 2"×4" wall. This step follows the wall preparations shown in FIG. 8P.

FIG. 18P illustrates an isometric view showing the prior art bullnose installed in a window having 2"×4" framing. This step follows the wall preparation shown in FIG. 8P and associated figures.

Figure 19:
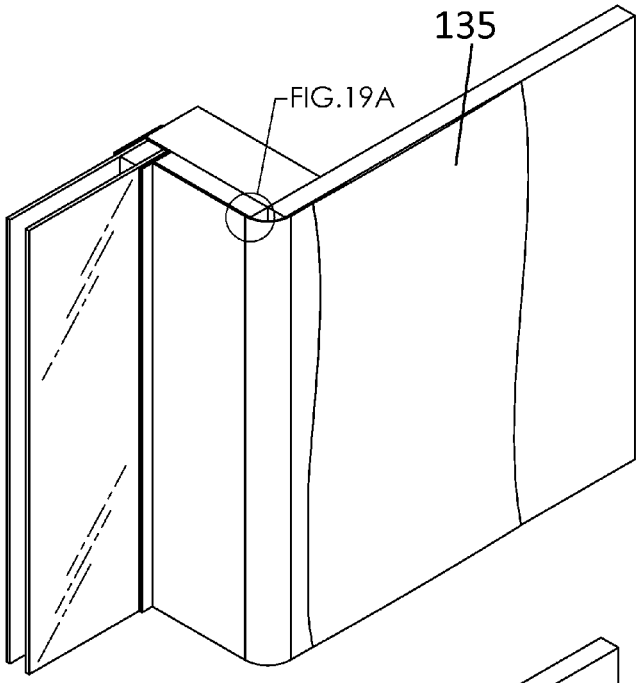
FIG. 19 is an isometric view showing next installations step after FIG. 18 for the new bullnose.

FIG. 19 illustrates an isometric view showing the steps following FIG. 18 for application. This illustrates that mud only has to be placed on one side 135 of the drywall pairing.

Figure 19P:
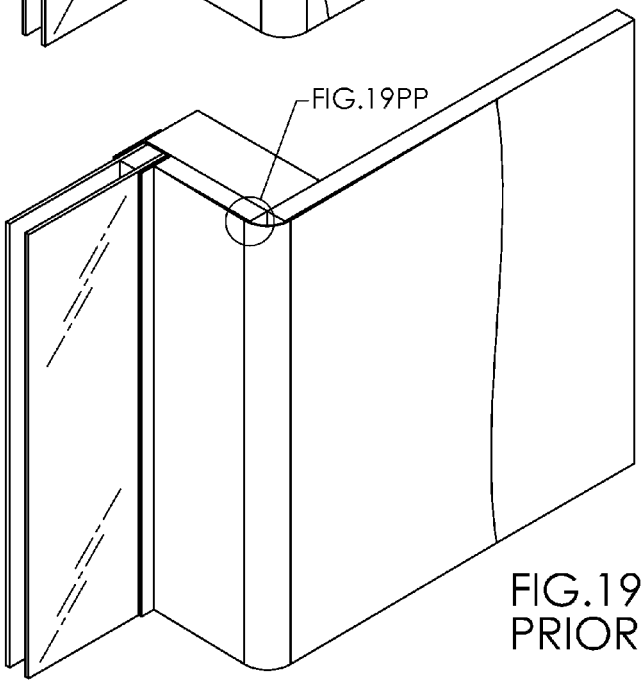
FIG.19P PRIOR ART
FIG. 19P is an isometric view showing the results for the next three installation steps after FIG. 18P for the prior art bullnose.

FIG. 19P illustrates that for prior art corner 146, mud must be applied at both drywall sides of 137.

Figure 19A:
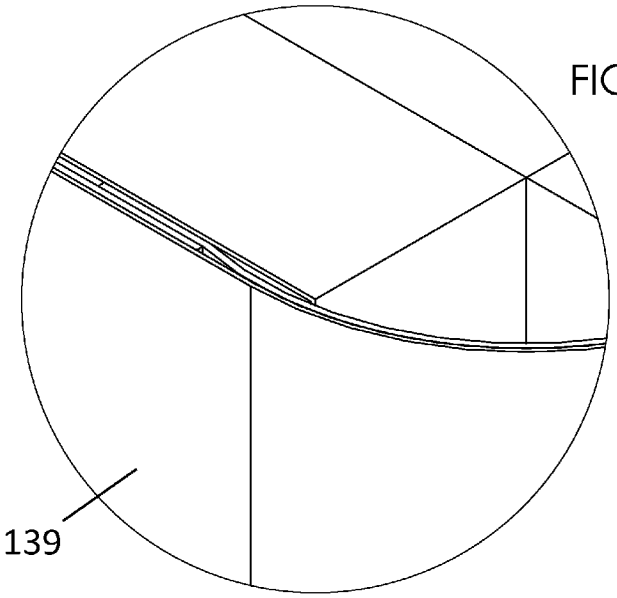
FIG. 19A is an isometric detail view of the finished corner for FIG. 19.
Figure 19P:
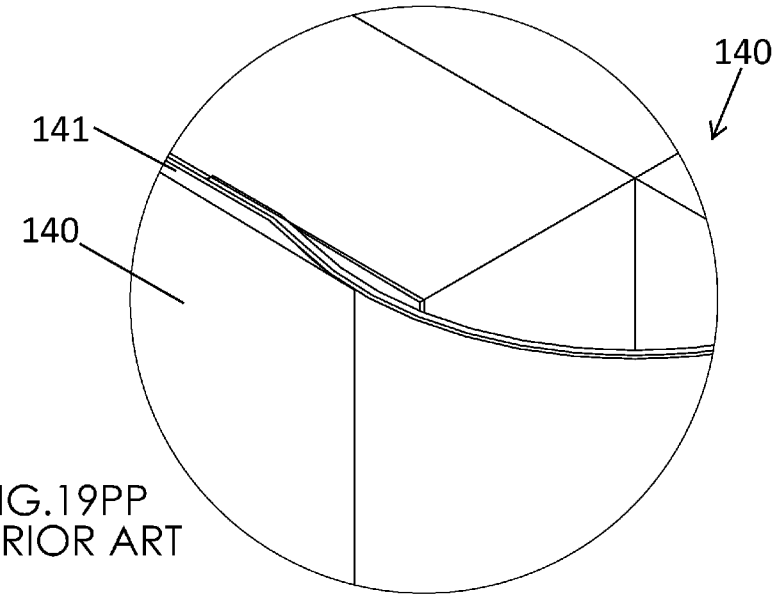
FIG.19PP PRIOR ART

FIG. 19A is an isometric detailed view of the finished corner for FIG. 19. This illustrates that no mud is required to finish the side of sheetrock 139.

FIG. 19PP illustrates the close up view of corner 140 of the prior art. Side 140 is required to be finished with mud 141 that is layered and sanded sequentially.

What is claimed is:

1. A drywall paper bead comprising:

an elongated core having an outer surface and an inner surface, wherein said elongated core comprises two flanges extending outward from a center of said elongated core, wherein said flanges comprise a recessed portion wherein said flanges are recessed beginning at a point outward from said center of said elongated core;

a base paper section, wherein said base paper section comprises an interior and an exterior, wherein said interior of said base paper section is configured for attachment to a sheet rock wall, wherein said exterior of said base paper section is attached to said inner surface of said elongated core, wherein said base paper section is configured to extend outward from said center of said elongated core to a point distal to the length of said two flanges of said elongated core;

at least two first intermediate paper sections, wherein said at least two first intermediate paper sections are attached to said exterior of said base paper layer, wherein said at least two first intermediate paper sections extend from an end of each of said flanges of said elongated core to an end point distal of said ends of said base paper layer;

at least two second intermediate paper sections, wherein said at least two second intermediate paper sections comprise an inner surface and an exterior surface; wherein said at least two second intermediate paper sections are attached to said outer surface of said elongated core at a point approximate to said recessed portion of said flanges of said elongated core and extending outward past the ends of said flanges to a point distal to the ends of said at least two first intermediate paper sections, wherein said at least two second intermediate paper sections generally fill said recessed portion of said flanges, wherein said inner surface of said at least two second intermediate papers sections extends distal to the end of said flanges of said elongated core and is attached to said exterior of said at least two first intermediate paper sections distal to said attachment with said elongated core;

an exterior paper section, wherein said exterior paper section is attached to said at least two second intermediate paper sections and to said elongated core, wherein said exterior paper section extends beyond the ends of said at least two second intermediate paper sections;

wherein said exterior paper section, said at least two first and at least two second intermediate paper sections, and said base paper section are layered in a tapered arrangement such that the end of said exterior section is further from said center of said elongate core than the end of said at least two first intermediate paper sections, said at least two second intermediate paper sections, and said base section.

2. The drywall paper bead of claim 1, wherein said drywall paper bead is treated for at least one of mold and fire resistance purposes.

3. The drywall paper bead of claim 1, wherein said elongate core comprises a galvanized metal elongate core.

4. The drywall paper bead of claim 3, wherein said elongate core is approximately 0.015 inches thick.

5. The drywall paper bead of claim 1, wherein said exterior paper section extends between approximately 1½ inches and 5¼ inches from the center of said elongate core.

6. The drywall paper bead of claim 1, wherein said at least two first and said at least two second intermediate paper layers comprise 9 pt paper.

7. The drywall paper bead of claim 1, wherein said exterior paper section comprises drywall trim paper.

8. The drywall paper bead of claim 1, wherein said recessed portion of said elongate core is approximately ⅛" deep.

9. The drywall paper bead of claim 1, wherein said elongate core comprises a plastic elongate core.

10. The drywall paper bead of claim 1, wherein said first and second intermediate paper layers are approximately 0.015" in thickness.

11. The drywall paper bead of claim 1, wherein said drywall paper bead is in the shape of a corner selected from the group consisting of bullnose, round corner bead, square kerf jambs, baby bull, L-metal, open angle, and thirty five degree corners.

12. The drywall paper bead of claim 1, wherein said elongate core is approximately 0.015 inches thick.

13. The drywall paper bead of claim 1, wherein said exterior paper section extends between approximately 1½ inches and 5¼ inches from the center of said elongate core.

14. A drywall corner bead, said corner bead comprising a plurality of drywall paper layers, wherein said plurality of drywall payer layers comprising:

a core layer, said core layer comprising an elongated core having a center and two flanges;

wherein said elongated core comprising an outer surface and an inner surface, wherein said outer surface and said inner surface are generally oriented on opposing sides of said flanges, wherein said elongated core comprises a recession, wherein said core layer comprises a paper flange abutting each of said two flanges of said elongated core, wherein said two flanges and said paper flanges extend away from said center of said elongated core in the same plane;

an interior paper layer, wherein said interior paper layer attached to said outer surface of said core layer, wherein said interior paper layer is connected to said elongated core at said recession of said elongated core and has a thickness that is generally equal to a depth of said recession; and an exterior paper layer bonded to said outer surface of said elongated core and said outer surface of said interior paper layer, wherein said exterior paper layer bonded to said outer surface of said elongated core extends to an end beyond an end of said elongated core; and a base layer, wherein said base layer comprises a paper section bonded to said inner surface of said core layer, wherein said paper section bonded to said inner surface of said core layer extends beyond a first end of said elongated core and a second end of said elongated core;

wherein said drywall paper layers are configured to provide a tapered appearance such that said exterior layer is wider than said base layer, with all layers between said exterior layer and said base layer being of width to present a tapered appearance.

15. The drywall paperbead of claim 14, wherein said paper is treated for at least one of mold and fire resistance purposes.

16. The drywall paper bead of claim 14, wherein said drywall paper bead is in the shape of a corner selected from the group consisting of bullnose, round corner bead, square kerf jambs, baby bull, L-metal, open angle, and thirty five degree corners.

17. The drywall paper bead of claim 14, wherein said elongate core comprises a galvanized metal elongate core.

18. The drywall paper bead of claim 14, wherein said recessed portion of said elongate core is approximately ⅛" deep.

19. A method of installing a drywall paperbead, wherein said method comprises the following steps:

1) obtaining a drywall paper bead, wherein said step of obtaining a drywall paper bead comprises the obtaining a drywall paper bead comprising an elongated core having an outer surface and an inner surface, and a first end and a second end, wherein said outer surface and said inner surface generally are oriented in opposing directions, wherein said elongated core comprises at least one recession;

a plurality of paper sections, wherein said paper sections comprise the following:

a) an exterior paper section bonded to a portion of said outer surface, wherein said exterior paper section bonded to said outer surface extends to an end beyond said first end of said elongated core and said second end of said elongated core;

b) a base paper section bonded to said inner surface, wherein said base paper section bonded to said inner surface extends beyond said first end of said elongated core and said second end of said elongated core, wherein said base paper section extends to a point shorter than said end of said exterior paper section bonded to said outer surface c) a first and a second medial paper section bonded to an outer surface of said base paper section, wherein said first medial paper section and said second medial paper section extend generally from a location adjacent to or connecting to said first end of said elongated core and said second end of said elongated core, respectively;

d) two gap sections, wherein said two gap sections are connected to said outer surface of said elongated core and an inner surface of said exterior paper section, wherein said gap sections are connected to said elongated core at said recession of said elongated core and have a thickness that is generally equal to a depth of said recession;

wherein said exterior paper section extends to ends further than the ends of said two gap sections, wherein said two gap sections extend to ends further than said first and said second medial paper sections, wherein said first and said second medial paper sections extend to ends further than the ends of said base paper section bonded to said inner surface, wherein said drywall paper layers plurality of paper section are configured to provide a tapered appearance; and 2) applying said drywall paperbead, wherein said paperbead is applied by placing said paperbead on a corner area and applying joint compound to at least one edge of said paperbead.

* * * * *